US005913382A

United States Patent [19]

Martin

[11] Patent Number: 5,913,382

[45] Date of Patent: Jun. 22, 1999

[54] LADDER EXTENSION SYSTEM

[76] Inventor: Jeffrey L. Martin, 626 Woodcrest Ave., Lititz, Pa. 17543

[21] Appl. No.: 09/001,431

[22] Filed: Dec. 31, 1997

[51] Int. Cl.[6] ..... E06C 1/00

[52] U.S. Cl. ..... 182/204; 182/107; 182/200; 182/205; 248/188.5

[58] Field of Search ..... 182/200, 201, 182/202, 203, 204, 205, 107, 108, 109, 111, 194; 248/188.3, 188.5, 188.8

[56] References Cited

U.S. PATENT DOCUMENTS

| | | | |
|---|---|---|---|
| D. 359,365 | 6/1995 | Greene et al. | D25/68 |
| 2,371,460 | 3/1945 | Needham | 182/204 |
| 2,392,527 | 1/1946 | Divil | 182/204 |
| 2,936,849 | 5/1960 | Larson | 182/204 |
| 3,260,329 | 7/1966 | Zevely | 182/202 |
| 3,724,592 | 4/1973 | Fleischer | 182/203 X |
| 3,861,500 | 1/1975 | Dempsey | 182/204 |
| 4,029,174 | 6/1977 | Planck et al. | 182/204 |
| 4,209,078 | 6/1980 | Gerber | 182/204 X |
| 5,107,958 | 4/1992 | Johnson | 182/204 |
| 5,148,892 | 9/1992 | Lu | 182/201 |
| 5,325,936 | 7/1994 | Baker | 182/204 |
| 5,335,754 | 8/1994 | Gibson | 182/204 |
| 5,551,529 | 9/1996 | Molitor | 182/204 |
| 5,704,451 | 1/1998 | King | 182/204 |

*Primary Examiner*—Daniel P. Stodola
*Assistant Examiner*—Bruce A. Lev

[57] ABSTRACT

A ladder extension system including a ladder having two sets of parallel vertically oriented supports each fixedly coupled at a top extent thereof. At least one of the sets of supports has a plurality of horizontal wrungs mounted therebetween for stepping purposes. Each of the vertically oriented supports has a bottom free end. A pair of mounting assemblies are removably mounted to the supports of the ladder. Next provided is a pair of extension bars slidably situated with respect to the mounting assemblies. A coupling mechanism is provided for releasably fixing the extension bars with respect to the mounting assemblies.

3 Claims, 3 Drawing Sheets

FIG 1
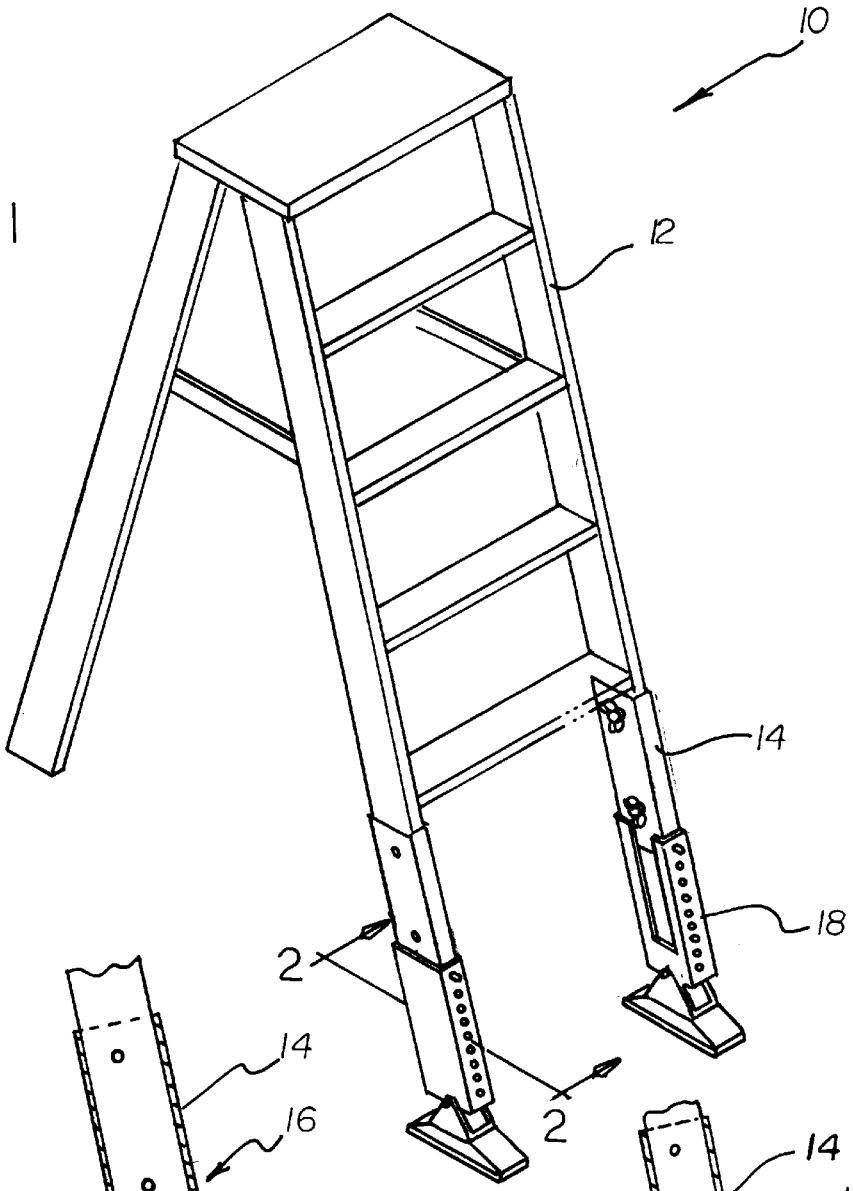
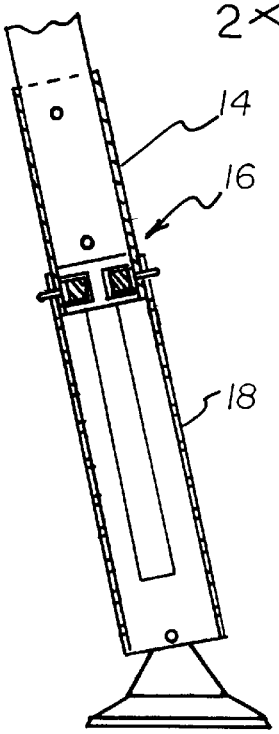
FIG. 2
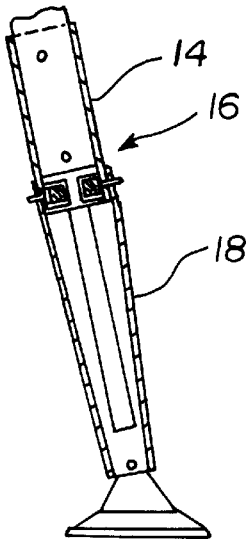
FIG. 7

LADDER EXTENSION SYSTEM

BACKGROUND OF THE INVENTION

1. Field of the Invention

The present invention relates to ladder extensions and more particularly pertains to a new ladder extension system for affording a unique method of allowing the selective adjustment of a pair of ladder support extenders which may be easily retrofitted to an existing ladder.

2. Description of the Prior Art

The use of ladder extensions is known in the prior art. More specifically, ladder extensions heretofore devised and utilized are known to consist basically of familiar, expected and obvious structural configurations, notwithstanding the myriad of designs encompassed by the crowded prior art which have been developed for the fulfillment of countless objectives and requirements.

Known prior art ladder extensions include U.S. Pat. No. 3,964,574; U.S. Pat. No. 5,325,936; U.S. Pat. No. 5,107,958; U.S. Pat. No. 5,335,754; U.S. Pat. Des. 359,365; and U.S. Pat. No. 5,273,133.

In these respects, the ladder extension system according to the present invention substantially departs from the conventional concepts and designs of the prior art, and in so doing provides an apparatus primarily developed for the purpose of affording a unique method of allowing the selective adjustment of a pair of ladder support extenders which may be easily retrofitted to an existing ladder.

SUMMARY OF THE INVENTION

In view of the foregoing disadvantages inherent in the known types of ladder extensions now present in the prior art, the present invention provides a new ladder extension system construction wherein the same can be utilized for affording a unique method of allowing the selective adjustment of a pair of ladder support extenders which may be easily retrofitted to an existing ladder.

The general purpose of the present invention, which will be described subsequently in greater detail, is to provide a new ladder extension system apparatus and method which has many of the advantages of the ladder extensions mentioned heretofore and many novel features that result in a new ladder extension system which is not anticipated, rendered obvious, suggested, or even implied by any of the prior art ladder extensions, either alone or in any combination thereof.

To attain this, the present invention generally comprises a ladder having two sets of parallel vertically oriented supports each fixedly coupled at a top extent thereof in an inverted V-shaped configuration. At least one of the sets of supports have a plurality of horizontal wrungs mounted therebetween for stepping purposes. Each of the vertically oriented supports have a bottom free end with a rectangular horizontal cross-section along a length thereof. Note FIG. 1. Also included is a pair mounting sleeves each having a hollow rectangular configuration. Such pair of mounting sleeves arc equipped with a constant horizontal cross-section along an entire height thereof which is defined by a pair of large closed side faces and a pair of thin closed end faces. These faces in turn form an inner perimeter of a first length and an outer perimeter of a second length. Each mounting sleeve further has an open top for allowing the insertion of the bottom end of one of the supports of the ladder therein. A pair of apertures are formed in the side faces of the sleeve for allowing the insertion of a pair of bolts through both the ladder and the apertures thus securing the mounting sleeves to the ladder. Mounted within a bottom end of an associated one of the mounting sleeves is a pair of pin assemblies. Each pin assembly has a pair of compartments formed therein adjacent to respective end faces of the mounting sleeve. A pair of metal coil springs is situated within the compartments. A pair of pin units each has a circular plate with a rod extending outwardly therefrom in concentric relationship therewith. The plate of each pin unit is situated within the associated compartment such that the rod extends through an aperture formed in the end face of the corresponding sleeve. The pins are each urged outwardly by the associated spring. Finally, a pair of extension bars each have a hollow rectangular configuration with a constant horizontal cross-section along an entire height thereof. Each extension bar is defined by a pair of large side faces, a pair of thin closed end faces, and an inner perimeter of the second length. The end faces of the extension bars each has a plurality of linearly aligned circular apertures formed therein. One of the side faces has an elongated slot formed along an entire length thereof. Note FIGS. 1 & 2. During use, the extension bars are each slidably situated over the corresponding mounting sleeve to define extensions of the supports of the ladder. The pin units of each pin assembly may be removably situated within the apertures formed in the extension bars for allowing the selective adjustment of the length of the supports of the ladder. Each extension bar further includes a triangular-shaped foot pivotally coupled to a bottom end thereof. A base of each foot has an outer perimeter of a third length which is greater than the second length.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new ladder extension system apparatus and method which has many of the advantages of the ladder extensions mentioned heretofore and many novel features that result in a new ladder extension system which is not anticipated, rendered obvious, suggested, or even implied by any of the prior art ladder extensions, either alone or in any combination thereof.

It is another object of the present invention to provide a new ladder extension system which may be easily and efficiently manufactured and marketed.

It is a further object of the present invention to provide a new ladder extension system which is of a durable and reliable construction.

An even further object of the present invention is to provide a new ladder extension system which is susceptible of a low cost of manufacture with regard to both materials and labor, and which accordingly is then susceptible of low prices of sale to the consuming public, thereby making such ladder extension system economically available to the buying public.

Still yet another object of the present invention is to provide a new ladder extension system which provides in the apparatuses and methods of the prior art some of the advantages thereof, while simultaneously overcoming some of the disadvantages normally associated therewith.

Still another object of the present invention is to provide a new ladder extension system for affording a unique in method of allowing the selective adjustment of a pair of ladder support extenders which may be easily retrofitted to an existing ladder.

Even still another object of the present invention is to provide a new ladder extension system that includes a ladder having two sets of parallel vertically oriented supports each fixedly coupled at a top extent thereof. At least one of the sets of supports has a plurality of horizontal wrungs mounted therebetween for stepping purposes. Each of the vertically oriented supports has a bottom free end. A pair of mounting assemblies are removably mounted to the supports of the ladder. Next provided is a pair of extension bars slidably situated with respect to the mounting assemblies. A coupling mechanism is provided for releasably fixing the extension bars with respect to the mounting assemblies.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new ladder extension system according to the present invention.

FIG. 2 is a cross-sectional view of the present invention taken along line 2—2 shown in FIG. 1.

FIG. 7 is a cross-section view of an optional embodiment of the present invention taken from a perspective similar to line 2—2 shown in FIG. 1.

DESCRIPTION OF THE PREFERRED EMBODIMENT

Figure 3:
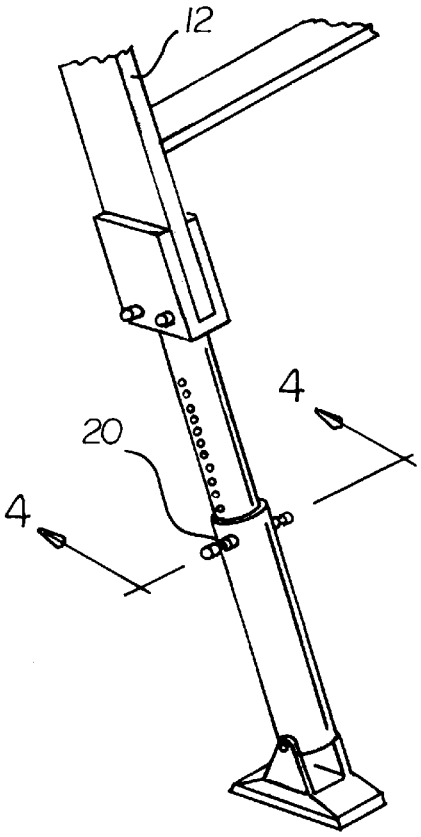
FIG. 3 is a perspective view of an alternate embodiment of the present invention.

With reference now to the drawings, and in particular to FIGS. 1 through 7 thereof, a new ladder extension system embodying the principles and concepts of the present invention and generally designated by the reference numeral 10 will be described.

The present invention, designated as numeral 10, includes a ladder 12 having two sets of parallel vertically oriented supports each fixedly coupled at a top extent thereof in an inverted V-shaped configuration. At least one of the sets of supports have a plurality of horizontal wrungs mounted therebetween for stepping purposes. Each of the vertically oriented supports have a bottom free end with a rectangular horizontal cross-section along a length thereof. Note FIG. 1.

Also included is a pair mounting sleeves 14 each having a hollow rectangular configuration. Such pair of mounting sleeves are equipped with a constant horizontal cross-section along an entire height thereof which is defined by a pair of large closed side faces and a pair of thin closed end faces. These faces in turn form an inner perimeter of a first length and an outer perimeter of a second length.

Each mounting sleeve further has an open top for allowing the insertion of the bottom end of one of the supports of the ladder therein. A pair of vertically aligned apertures are formed in a central extent of the side faces of the sleeve for allowing the insertion of a pair of bolts through both the ladder and the apertures thus securing the mounting sleeves to the ladder. Such bolts preferably employ the use of a wing nut for the convenient retrofitting of the present invention. As an option, the inner perimeter of each mounting sleeve may lessen from the bottom end to the top end thereto so as to afford a wedging affect in conjunction with the supports of the ladder.

Mounted within a bottom end of an associated one of the mounting sleeves is a pair of pin assemblies 16. Each pin assembly has a pair of compartments formed therein adjacent to respective end faces of the mounting sleeve, as shown in FIG. 2. A pair of metal coil springs is situated within the compartments. A pair of pin units each has a circular plate with a rod extending outwardly therefrom in concentric relationship therewith. The plate of each pin unit is situated within the associated compartment such that the rod extends through an aperture formed in the corresponding end face of the corresponding sleeve. The pins are each urged outwardly by the associated spring.

Finally, a pair of extension bars 18 each have a hollow rectangular configuration with a constant horizontal cross-section along an entire height thereof. Each extension bar is defined by a pair of large side faces, a pair of thin closed end faces, and an inner perimeter of the second length. The end faces of the extension bars each has a plurality of linearly aligned circular apertures formed therein along an entire length thereof. One of the side faces has an elongated slot formed along nearly an entire length thereof. Note FIGS. 1 & 2. In the preferred embodiment, the length of the extension bars is approximately equal to that of the mounting sleeves.

During use, the extension bars are each slidably situated over the corresponding mounting sleeve to define extensions of the supports of the ladder. The pin units of each pin assembly may be removably situated within the apertures formed in the extension bars for allowing the selective adjustment of the length of the supports of the ladder. Each extension bar further includes a triangular-shaped foot pivotally coupled to a bottom end thereof. The aforementioned elongated slots of the extension bars preferably cease short of the bottom ends thereof so as to afford space for the coupling of the feet. A base of each foot has an outer perimeter of a third length which is greater than the second length.

Figure 4:
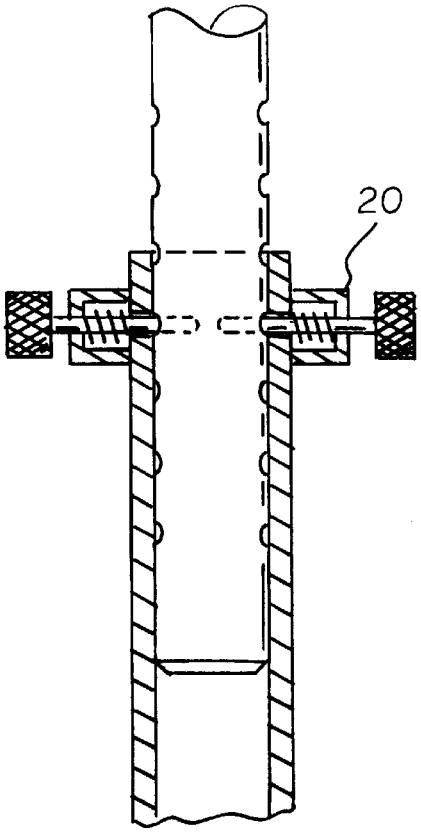
FIG. 4 is a cross-sectional view of the present invention taken along line 4—4 shown in FIG. 3.
Figure 5:
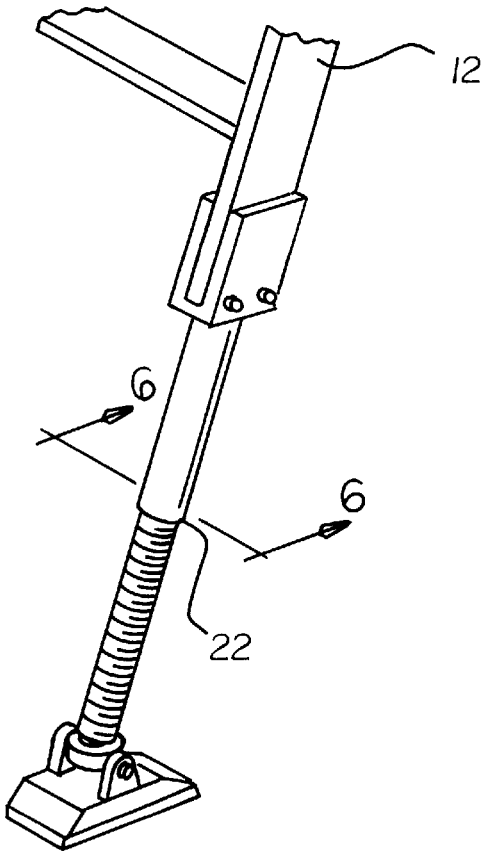
FIG. 5 is a perspective view of another alternate embodiment of the present invention.
Figure 6:
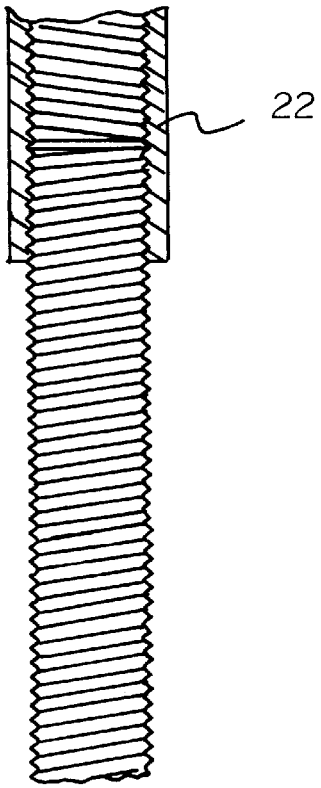
FIG. 6 is a cross-sectional view of the alternate embodiment of the present invention shown in FIG. 5.

In an alternate embodiment, the mounting sleeves may be excluded and the pin assemblies mounted directly to the supports of the ladder. As yet another alternative, the pin units 20 may be configured as shown in FIGS. 3 & 4 on an exterior of the extension bars such that they must be pulled to disengage apertures formed in the mounting sleeves. Further in such embodiment, the extension bar has a circular cross-section. In yet another embodiment, a threaded coupling 22 is employed between the extension bars and mounting sleeves. Note FIGS. 5 & 6.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A retrofittable ladder extension system comprising:

a ladder having two sets of parallel vertically oriented supports each fixedly coupled at a top extent thereof in an inverted V-shaped configuration, at least one of the sets of supports having a plurality of horizontal wrungs mounted therebetween for stepping purposes, each of the vertically oriented supports having a bottom free end with a rectangular horizontal cross-section along a length thereof;

a pair of mounting sleeves each having a hollow rectangular configuration with a constant horizontal cross-section along an entire height thereof which is defined by a pair of large closed side faces, a pair of thin closed end faces, an inner perimeter of a first length and an outer perimeter of a second length, each mounting sleeve further having an open top for allowing the insertion of the bottom end of one of the supports of the ladder therein and a pair of apertures formed in both of the side faces of the sleeve for allowing the insertion of a pair of bolts through both the ladder and the apertures thereby securing the mounting sleeves to the ladder via nuts, wherein the inner perimeter of each mounting sleeve lessens from a bottom end to the open top so as to afford a wedging affect in conjunction with the supports of the ladder;

a pair of pin assemblies each mounted within a bottom end of an associated one of the mounting sleeves, each pin assembly having a pair of compartments formed within the mounting sleeve adjacent to respective end faces of the mounting sleeve, a pair of metal coil springs situated within the compartments, a pair of pin units each having a circular plate with a rod extending outwardly therefrom in concentric relationship therewith, wherein the plate is situated within the associated compartment and the rod extends through an aperture formed in the end face of the corresponding sleeve wherein the pins are each urged outwardly by the associated spring; and a pair of extension bars each having a hollow rectangular configuration with a constant horizontal cross-section along an entire height thereof which is defined by a pair of large side faces, a pair of thin closed end faces, and an inner perimeter of a length equal to the second length, the end faces of the extension bars each having a plurality of linearly aligned circular apertures formed therein, an inner one of the side faces having an elongated slot formed along an entire length thereof for allowing the passage of the nuts, wherein the slot terminates short of a bottom end of the associated extension bar, wherein the extension bars are each slidably situated over the corresponding mounting sleeve to define extensions of the supports of the ladder such that the pin units of the pin assembly may be removably situated within the apertures formed in the extension bars for allowing the selective adjustment of the length of the supports of the ladder, wherein a length of each of the extension bars is equal to that of the mounting sleeves, each extension bar further including a triangular-shaped foot pivotally coupled to the bottom end thereof, wherein a base of each foot has an outer perimeter of a third length which is greater than the second length.

2. A retrofittable ladder extension system as set forth in claim 1 wherein the nuts are wing nuts.

3. A retrofittable ladder extension system adapted for use with a ladder having two sets of parallel vertically oriented supports each fixedly coupled at a top extent thereof in an inverted V-shaped configuration, at least one of the sets of supports having a plurality of horizontal wrungs mounted therebetween for stepping purposes, each of the vertically oriented supports having a bottom free end with a rectangular horizontal cross-section along a length thereof, the system comprising:

a pair of mounting sleeves each having a hollow rectangular configuration with a constant horizontal cross-section along an entire height thereof which is defined by a pair of large closed side faces, a pair of thin closed end faces, an inner perimeter of a first length and an outer perimeter of a second length, each mounting sleeve further having an open top for allowing the insertion of the bottom end of one of the supports of the ladder therein and a pair of apertures formed in both of the side faces of the sleeve for allowing the insertion of a pair of bolts through both the ladder and the apertures thereby securing the mounting sleeves to the ladder via nuts, wherein the inner perimeter of each mounting sleeve lessens from a bottom end to the open top so as to afford a wedging affect in conjunction with the supports of the ladder;

a pair of pin assemblies each mounted within a bottom end of an associated one of the mounting sleeves, each pin assembly having a pair of compartments formed within the mounting sleeve adjacent to respective end faces of the mounting sleeve, a pair of metal coil springs situated within the compartments, a pair of pin units each having a circular plate with a rod extending outwardly therefrom in concentric relationship therewith, wherein the plate is situated within the associated compartment and the rod extends through an aperture formed in the end face of the corresponding sleeve wherein the pins are each urged outwardly by the associated spring; and a pair of extension bars each having a hollow rectangular configuration with a constant horizontal cross-section along an entire height thereof which is defined by a pair of large side faces, a pair of thin closed end faces, and an inner perimeter of a length equal to the second length, the end faces of the extension bars each having a plurality of linearly aligned circular apertures formed therein, an inner one of the side faces having an elongated slot formed along an entire length thereof for allowing the passage of the nuts, wherein the slot terminates short of a bottom end of the associated extension bar, wherein the extension bars are each slidably situated over the corresponding mounting sleeve to define extensions of the supports of the ladder such that the pin units of the pin assembly may be removably situated within the apertures formed in the extension bars for allowing the selective adjustment of the length of the supports of the ladder, wherein a length of each of the extension bars is equal to that of the mounting sleeves, each extension bar further including a triangular-shaped foot pivotally coupled to the bottom end thereof, wherein a base of each foot has an outer perimeter of a third length which is greater than the second length.

* * * * *